US005807653A

United States Patent [19]

Nishihara et al.

[11] Patent Number: 5,807,653

[45] Date of Patent: Sep. 15, 1998

[54] TONER FOR TWO-COMPONENT DEVELOPING AGENT

[75] Inventors: Yoshikazu Nishihara, Itami; Ichiro Demizu, Toyonaka; Yoshihiro Mikuriya, Amagasaki; Fumiko Nakazawa, Iwata; Hiroshi Fukao, Toyokawa, all of Japan

[73] Assignee: Minolta Co., Ltd., Osaka, Japan

[21] Appl. No.: 837,861

[22] Filed: Apr. 22, 1997

[30] Foreign Application Priority Data

Apr. 23, 1996 [JP] Japan ..... 8-101286

[51] Int. Cl.[6] ..... G03G 9/083

[52] U.S. Cl. ..... 430/106.6; 430/110

[58] Field of Search ..... 430/110, 109, 430/106, 111, 106.6

[56] References Cited

U.S. PATENT DOCUMENTS

| | | | |
|---|---|---|---|
| 4,355,088 | 10/1982 | Westdale et al. | 430/98 |
| 4,386,147 | 5/1983 | Seimiya et al. | 430/99 |
| 4,486,524 | 12/1984 | Fujisaki et al. | 430/109 |
| 4,578,338 | 3/1986 | Gruber et al. | 430/99 |
| 4,917,982 | 4/1990 | Tomono et al. | 430/99 |
| 4,939,060 | 7/1990 | Tomiyama et al. | 430/106.6 |
| 4,946,755 | 8/1990 | Inoue | 430/106.6 |
| 4,988,598 | 1/1991 | Tomono et al. | 430/99 |
| 4,997,739 | 3/1991 | Tomono et al. | 430/110 |
| 5,004,666 | 4/1991 | Tomono et al. | 430/110 |
| 5,023,158 | 6/1991 | Tomono et al. | 430/99 |
| 5,106,715 | 4/1992 | Matsumura et al. | 430/110 |
| 5,124,224 | 6/1992 | Berkes et al. | 430/110 |
| 5,171,653 | 12/1992 | Jugle et al. | 430/108 |
| 5,176,978 | 1/1993 | Kumasiro et al. | 430/110 |
| 5,624,778 | 4/1997 | Sato et al. | 430/106.6 |
| 5,660,964 | 8/1997 | Machida et al. | 430/111 |
| 5,665,512 | 9/1997 | Tsutsui et al. | 430/110 |

*Primary Examiner*—John Goodrow

[57] ABSTRACT

A toner for two-component developing agent is provided which can prevent smearing and offsetting during copying operation, and which is not liable to fluidity decrease and chargeability deterioration. The toner contains polyethylene and polypropylene as toner waxes and incorporates a magnetic powder having a certain BET specific surface area.

20 Claims, 6 Drawing Sheets

TONER FOR TWO-COMPONENT DEVELOPING AGENT

BACKGROUND OF THE INVENTION

1. Field of the Invention

The present invention relates to a toner for two-component developing agents.

2. Description of the Related Art

Fixing systems employed in image forming apparatuses, such as electrophotographic apparatuses, include non-contact heat fixing systems, such as pressure fixing system, flash fusing system, and oven fusing system, and a contact heat fixing system, such as heated roll fixing. The contact heat fixing system in particular is most widely used because the system is well adaptable for high speed operation in contrast to the pressure fixing system, and because it provides higher thermal efficiency as compared with the non-contact heat fixing systems and can utilize a heat source of relatively low temperature, which enables apparatus compact and energy saving.

In recent years, further high-speed operation and energy saving features have been required with respect to electrophotographic apparatuses of such contact heat fixing system, and accordingly a low-temperature fixing characteristic has been required of toners. Low temperature fixing, when realized, can not only result in further energy saving, but also can enable reduction in warm-up time, thus providing for improved operation performance.

The above described contact heat fixing system involves the problem of offset phenomenon. In the case of the heated roll fixing system, for example, this phenomenon is such that during a fixing operation, a portion of image-forming toner particles is transferred to the surface of the heated roll and the particles so transferred are re-transferred onto a succeeding transfer sheet to impair the image formed.

Hitherto, a technique for preventing toner offset in heated roll fixing has been known such that a polypropylene wax is added as an anti-offset agent (release agent) into the toner (as described in, for example, Japanese Patent Application Laid-Open No. 49-65231).

Recently, with development of copying machines incorporating electrophotography which can operate at higher speed and has a greater variety of functions, a copying machine equipped with an automatic document feed device and/or a duplex copying device has become a contemporary standard in the art. Such devices may involve disagreeable phenomena such as image blur and stains which occur when a reproduced image surface is rubbed by the sheet feed roller in the process of document feed or back side copying, or second copying in a multicolor copying operation. Similar phenomena are liable to occur when copy sheets temporarily kept in stack within the copying machine are removed one by one by means of the sheet feed roller for a second cycle of copying operation. Naturally, such phenomena are a cause of image quality degradation. Where a toner involves such a problem, the toner is classified as having defective smear characteristics.

An effective way to overcome the problem of smearing is to add a polyethylene wax into the toner. However, this poses a problem that the use of polyethylene wax in combination with above mentioned polypropylene wax, an offset preventive agent, tends to cause filming and toner degradation in fluidity and chargeability.

SUMMARY OF THE INVENTION

The object of the present invention is to provide a new and useful toner for electrostatic charge developing agent in which the aforementioned problems are solved.

Other object of the present invention is to provide a toner for electrostatic charge developing agent excellent in smear resistance.

Further object of the present invention is to provide a toner for electrostatic charge developing agent which can control the generation of offsetting and filming.

Furthermore object of the present invention is to provide a toner for electrostatic charge developing agent improved in fluidity and chargeability.

Additional object of the present invention is to provide a toner for electrostatic charge developing agent excellent in abrasive effect and less toner dusting and spillage.

The invention presents a toner used for two-component developing agent containing at least a magnetic carrier and a toner, which toner comprises at least a binder resin, colorants, waxes containing polyethylene and polypropylene, and magnetic powders, in which the total amount of the polyethylene and polypropylene is in the range of 2 to 10 parts by weight relative to 100 parts by weight of the binder resin, the weight ratio of the polypropylene to the polyethylene is 10:1 to 1:10, said magnetic powder has a BET specific surface area of from 2 to 15 $m^2/g$, and the amount of from 1 to 150 parts by weight relative to 100 parts by weight of the binder resin.

These and other objects, advantages and features of the present invention will become apparent from the following description thereof taken in conjunction with the accompanying drawings which illustrate specific embodiment of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
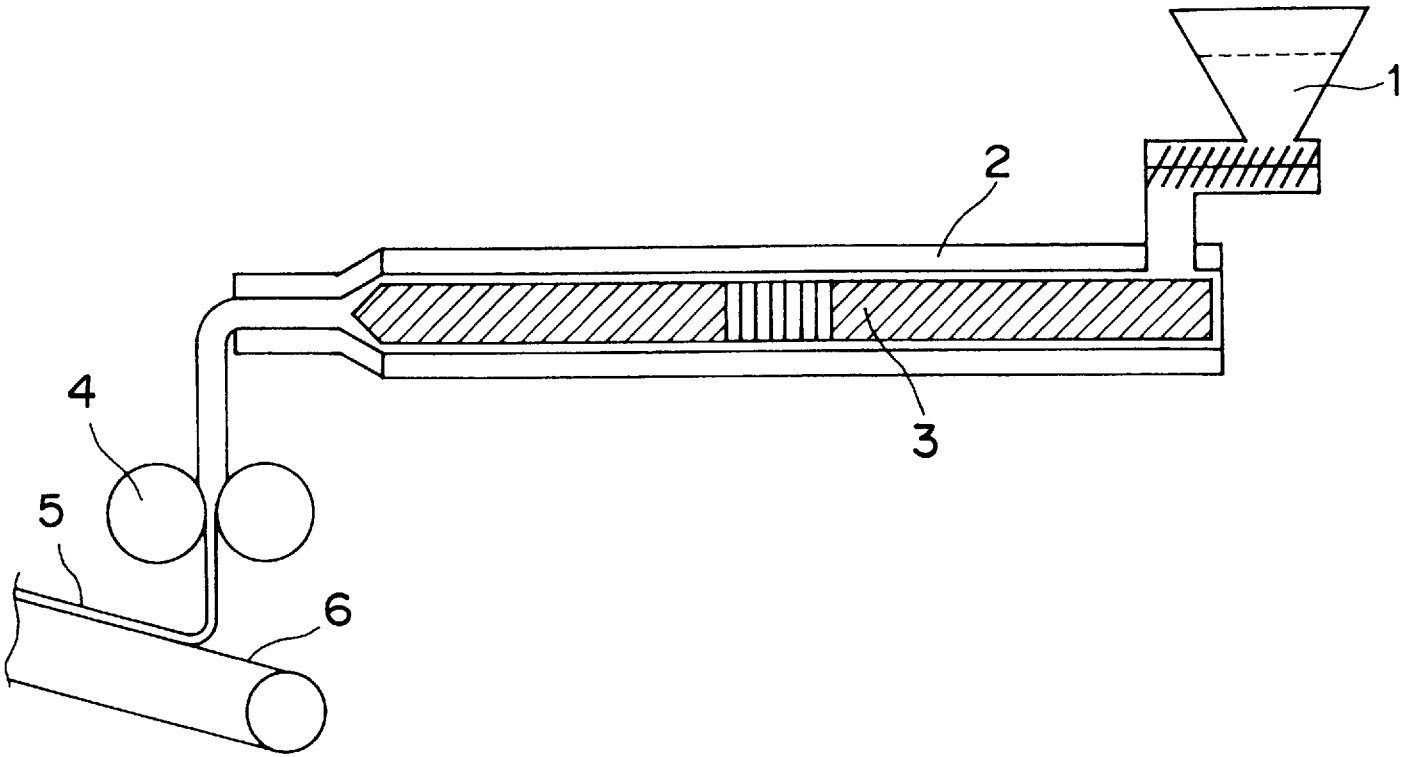
FIG. 1 is a schematic view of a kneading machine equipped with press rollers.

The toner of the present invention composed of a wax containing at least a binder resin, a coloring agent, a magnetic powder, polyethylene and polypropylene.

The present invention relates to a toner used for two-component developing agent containing at least a magnetic carrier and a toner, which toner comprises at least a binder resin, colorants, waxes containing polyethylene and polypropylene, and magnetic powders, in which the total amount of the polyethylene and polypropylene is in the range of 2 to 10 parts by weight relative to 100 parts by weight of the binder resin, the weight ratio of the polypropylene to the polyethylene is 10:1 to 1:10, said magnetic powder has a BET specific surface area of from 2 to 15 $m^2/g$, and the amount of from 1 to 150 parts by weight relative to 100 parts by weight of the binder resin.

Waxes used in the present invention are composed mainly of polyethylene and polypropylene, but may include other waxes, such as carnauba wax, SASOL wax, and rice wax, which are usually incorporated in a toner, insofar as the use of such other wax is not detrimental to the object of the invention.

The polyethylene used in the present invention has a softening point of from 100° C. to 150° C., preferably 130° C. to 145° C., which is lower than the softening point of the polypropylene used in combination therewith. Preferably, a polyethylene which is 3° to 30° C. lower in softening point than the polypropylene is suitably used. If the softening point of the polyethylene is less than 100° C., the toner has low heat resistance and is liable to filming. If the softening point is higher than 150° C., smear preventive characteristic of the toner obtained becomes poor.

For the polyethylene, either high-density polyethylene or low-density polyethylene may be used, but high-density polyethylene is preferred particularly from the standpoint of improvement of smear preventive characteristic.

The polypropylene used in the present invention is preferably one having a softening point of from 140° C. to 160° C., more preferably from 145° C. to 155° C. If the softening point is lower than 140° C., the toner has low heat resistance and has a tendency to form filming. If the softening point is higher than 160° C., the toner has low anti-offset characteristic.

In the present invention, the total amount of the polyethylene and polypropylene used is in the range of from 2 to 10 parts by weight, preferably from 3 to 7 parts by weight, for each 100 parts by weight of the binder resin. If the total amount is less than 2 parts by weight, the toner has low anti-offset characteristic and low smear preventive characteristic. If the total amount is more than 10 parts by weight, the obtained toner has tendency to form filming and reduces fog-restraining property and fluidity.

The weight ratio of the polypropylene to the polyethylene is in the range of from 10:1 to 1:10, preferably from 10:1 to 1:2, more preferably from 10:1 to 1.5:1. If the amount of the polypropylene is more than its upper limit given above, the smear preventive effect is lowered, whereas if the amount of polyethylene is more, the anti-offset effect is lowered.

The toner of the invention also includes magnetic powders. The magnetic powders can impart polish effect to the photosensitive member to thereby prevent filming and can also serve to prevent toner dusting or spill by its magnetic force. Further, the inclusion of the magnetic powder provides for improvement in the smear preventive property and anti-offset characteristic of the toner.

The magnetic powders used in the invention have a BET specific surface area of from 2 to 15 $m^2/g$, preferably from 5 to 12 $m^2/g$. If the BET specific surface area is larger than 15 $m^2/g$ or smaller than 2 $m^2/g$, there will occur a decrease in chargeability of the toner due to unsatisfactory dispersion of the magnetic powders in the toner.

The range of saturation magnetization of the toner is preferably from 0.05 emu/g to 30 emu/g, more preferably from 0.1 emu/g to 5 emu/g. Where saturation magnetization is less than 0.05 emu/g, no sufficient cleaning effect can be obtained with respect to the surface of the photoconductive member, with the result that the toner is liable to filming. In addition, such a low degree of saturation magnetization will readily result in toner dusting and spill. Where saturation magnetization is more than 30 emu/g, the developing capability of the toner is lowered, which results in reduced image density.

The magnetic powder content of the toner is preferably in the range of from 1 to 150 parts by weight, more preferably from 2 to 100 parts by weight, further preferably from 2 to 10 parts by weight, for each relative to 100 parts by weight of the binder resin.

If the magnetic powder content is less than 1 part by weight, the intended effect of the invention cannot be obtained. If the magnetic powder content is more than 150 parts by weight, the developing capability of the toner is lowered, which results in reduced image density. For the magnetic powder, ferrite, magnetite, and iron may be used alone or in mixture.

Binder resins useful for the purpose of the invention include those conventionally used as toner binder resins, such as styrene copolymer resins, polyester resins, and epoxy resins, which may be arbitrarily used as such. However, in order to more effectively achieve the object of the invention, styrene copolymer resins are particularly preferred for use as binder resins.

Examples of styrene monomer constituents of styrene copolymers resins useful for the purpose of the invention include styrene, α-methyl styrene, p-methyl styrene, p-tert-butyl styrene, and p-chlorostyrene, and derivatives of these styrene monomers.

Examples of monomers to be copolymerized with such styrene monomers include methacrylate alkyl esters such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl) butyl, hexyl methacrylate, octyl methacrylate, nonyl methacrylate, decyl methacrylate, undecyl methacrylate, and dodecyl methacrylate; acrylate alkyl esters such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl)butyl acrylate, hexyl acrylate, octyl acrylate, nonyl acrylate, decyl acrylate, undecyl acrylate, and dodecyl acrylate; unsaturated carboxylic acids such as acrylic acid, methacrylic acid, itaconic acid, and maleic acid; and vinyl monomers such as acrylonitrile, maleic acid esters; itaconic acid esters, vinyl chloride, vinyl acetate, vinyl benzoate, vinyl methyl ethyl ketone, vinyl hexyl ketone, vinyl methyl ether, vinyl ethyl ether, and vinyl isobutyl ether. Preferably, methacrylate alkyl esters in which alkyl groups have a carbon number of 1 to 17 and acrylate alkyl esters in which alkyl groups have a carbon number of 1 to 17 are used.

In order to improve the dispersibility of the colorant and the like, the binder resin may be given an acid value. The acid value of a styrene copolymer resin is controlled to not more than 10.0 KOHmg/g, preferably to a range of from 3 to 10 KOHmg/g, by allowing the styrene copolymer to contain a regulated quantity of unsaturated carboxylic acid, such as (meth)acrylic acid.

The molecular weight of the binder resin is such that the binder resin preferably has a number-average molecular weight of 2000 to 10000, more preferably 2500 to 7000, the ratio of weight-average molecular weight/number-average molecular weight being from 20 to 90, more preferably from 25 to 80. If the number-average molecular weight is less than 2000, the toner has low heat resistance and is liable to involve the problem of offsetting. If the number-average molecular weight is more than 10000, the toner has low fixing capability. If the weight-average molecular weight/number-average molecular weight ratio is smaller than 20, the anti-offset characteristic of the toner is lowered, and if the ratio is larger than 90, the toner is liable to degradation in fixing capability.

The colorant to be used in the present invention may be any colorant which is conventionally used in electrophotographic toners, such as carbon black. Though there is no particular limitation with respect to the quantity of the colorant to be incorporated in the toner, preferably it is 1–20 parts by weight relative to 100 parts by weight of the binder resin.

Other additives for use in the toner of the invention include, for example, a charge control agent, a fluidizing agent, and a cleaning assistant (e. g., resin bead), which may be suitably mixed into the toner.

The charge control agent to be used in the invention may be either a positive charge control agent or a negative charge control agent.

Positive charge control agents which can be used in the present invention include, for example, nigrosine dye, triphenylmethane compound, and quaternary ammonium compound. For the triphenylmethane compound, compounds described in, for example, Japanese Patent Application Laid-Open Nos. Sho 51-11455, Sho 59-10045, and Sho 61-124955 may be used. For the quaternary ammonium compound, a compound as disclosed in, for example, Japanese Patent Application Laid-Open No. Hei 4-70849 may be used.

Examples of negative charge control agents include solicylic acid metal complex, metal-containing azo dye, calix arene compound, and boron-containing compound.

Where a fluidizing agent is to be used, various types of fine-grain materials can be used as such, including silica, titanium dioxide, alumina, magnesium fluoride, silicon carbide, boron carbide, titanium carbide, zirconium carbide, boron nitride, titanium nitride, zirconium nitride, magnetite, molybdenum disulfide, aluminum stearate, magnesium stearate, and zinc stearate.

It is preferable that such fine-grain material is hydrophobically treated with silane coupling agent, titanium coupling agent, higher fatty acid, silicone oil or the like before use.

The fluidizing agent is used in a quantity range of 0.05 to 5 parts by weight, preferably 0.1 to 3 parts by weight relative to 100 parts by weight of toner.

Also available for fluidizing purposes are various kinds of organic fine-particle materials which are granulated by wet polymerization methods such as emulsion polymerization, soap-free emulsion polymerization, and non-aqueous dispersion polymerization, or by vapor phase polymerization techniques, including those of styrene, acrylics, methacrylics, benzoguanamine, silicone, Teflon, polyethylene, and polypropylene, which may be used alone or in combination.

The toner of the present invention, in combination with a carrier, is used as a two-component developer. For the carrier to be used with the toner, any known carriers may be used including, for example, a carrier of the type which is comprised of magnetic particles, such as iron powder or ferrite, a coated carrier having a magnetic grain surface coated with resin or the like coating material, and a dispersion type carrier having magnetic fine powder dispersed in a binder resin mass. Preferably, the carrier has a volume-average particle size of from 15 to 100 $\mu$m, preferably from 20 to 80 $\mu$m.

Particularly preferred carriers have a saturation magnetization range of from 35 to 90 emu/g, more preferably from 40 to 70 emu/g. If the saturation magnetization is less than 35 emu/g, carrier fogging is likely to occur. If the saturation magnetization is more than 90 emu/g, the chargeability of the toner is lowered and, in addition, crest formation in the developing station is adversely affected, which may be a cause of rough image development.

Where the toner of the invention is to be used as a positive charge toner, a preferred carrier is such that the carrier has a spot for charging the toner or, in other words, such that a negative charge resin is present on the surface of the carrier. Examples of such resin are polyester resins, polyolefin resins, such as polyethylene, tetrafluoroethylene, vinylidene fluoride, and other fluorine-containing resins such as homopolymers of fluorine-containing vinyl monomers or copolymers of fluorine-containing vinyl monomers and other vinyl monomers. The most preferable carriers those having a negative charge resin coat formed thereon as mentioned above, or a carrier having magnetic fine powder dispersed in such negative charge resin as mentioned above in view of the chargeability when they are combined with the toner of the present invention.

Where the toner of the invention is to be used as a negative charge toner, a carrier having a positive charge resin present on its surface is preferred for use. Examples of such resin are acrylic resin, styrene-acrylic resin, and silicone resin.

The toner of the present invention is produced in the following way. Specified ingredients, including colorant, binder resin, magnetic powder, polyethylene, and polypropylene, are mixed in a mixing machine such as Henschel mixer. As FIG. 1 shows, the mixture 1 is kneaded while being continuously extruded under high shearing conditions in an extruder 3 having a heating jacket 2 such as screw extruder. The kneaded mixture is press-formed into belt form by a pair of press rollers 4 having a suitable nip clearance, and the resulting belt-like formed piece 5 is placed on a cooling conveyor 6 for being directed into a coarse grinding stage. In the kneading stage, both the polyethylene and the polypropylene are uniformly dispersed in the toner ingredients, but are not compatible with each other, so that most of their respective particles are present as independent particles.

The kneaded mixture obtained is then passed through the process of grinding and classifying, whereby the toner of the invention is obtained.

In grinding and classifying stages, it is desirable to classify subject particles by means of a grinding machine which can apply mechanical impact force on the particles or a classifier which can apply mechanical impact force on the particles. The term "mechanical impact force" herein means physical impact force that is generated when the particles come in contact with a rotor operated at high rotational speed, both the grinding machine and the classifier being equipped with such a rotor. The use of such grinder and classifier prevents generation of ultrafine powder of liberated wax or the like, helps stabilize the charging capability of the toner, and contributes toward improvement in anti-filming characteristic and fluidity of the toner.

Specifically, pulverization is carried out by disintegrating the kneaded toner mixture in dry state by means of a mechanical grinding machine.

Figure 2:
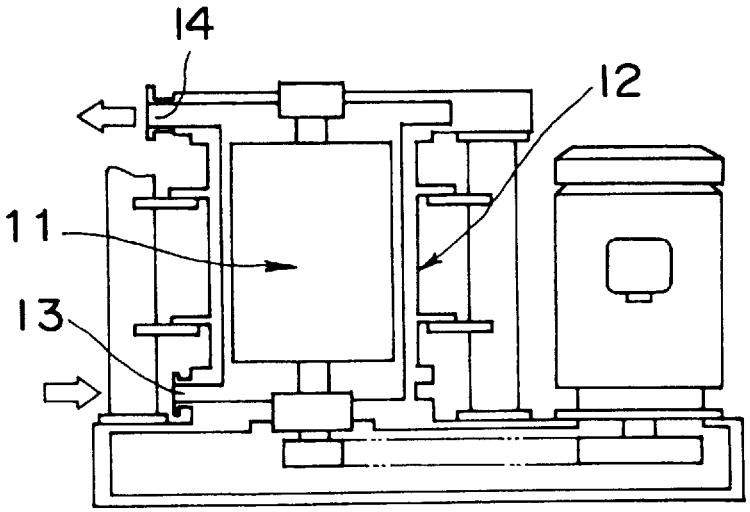
FIG. 2 is a view of a grinding machine.

A mechanical grinding machine which can apply mechanical impact force to subject particles includes a cylindrical vessel (outer cylinder) having grooves formed on its inner periphery, and a freely rotatable cylinder (inner cylinder) having grooves formed on its outer periphery which is disposed inside the outer cylinder and spaced a predetermined distance from the inner periphery of the outer cylinder. FIG. 2 shows a schematic skeleton view of this type of grinding machine.

A freely rotatable inner cylinder (rotor) 11 has a multiplicity of grooves formed on its outer periphery in the direction of rotation axis thereof. A cylindrical vessel (outer cylinder) 12 has a liner attached thereto, the liner having a multiplicity of grooves formed on its inner surface in a notched fashion in the direction of rotation axis of the cylinder. When vigorous eddy currents and pressure vibration are generated within the machine due to high speed rotation of the rotor 11, the raw material is sucked along with air through a suction port 13 and fed by air currents into a grinding chamber. Then, larger size particles are bulk crushed due to impact force applied by both the rotor 11 and the liner and also due to vigorous eddy currents of air generated in the gap between the rotor and the liner; and size-reduced particles undergo the process of surface grinding and, during that process, ultrafine powders of liberated wax or the like are fixedly attached to the surface of ground particles. Resulting particulate masses are discharged along with air from an exhaust port 14. Surface grinding means that particle surface is shaved off due to peeling effect of the grinding force applied and, at the same time, ultrafine powders are fixedly attached to particle surface, that is, particle surface rearrangement is effected. The use of such apparatus is desirable in that fibrillation can be prevented because atomized polyethylene and the like are again contained in the toner.

Figure 3A:
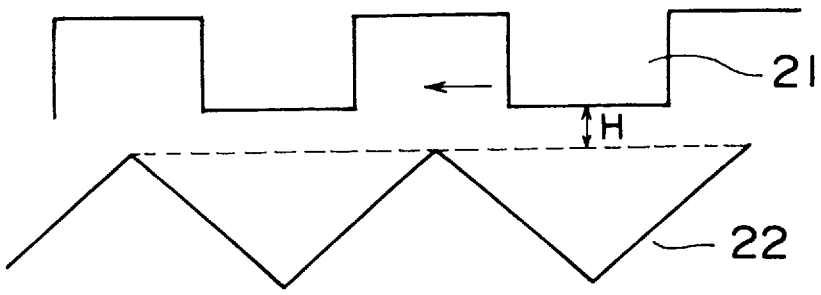
FIG. 3 is an illustration of the relation between a rotor and a liner in the grinding machine.
Figure 3B:
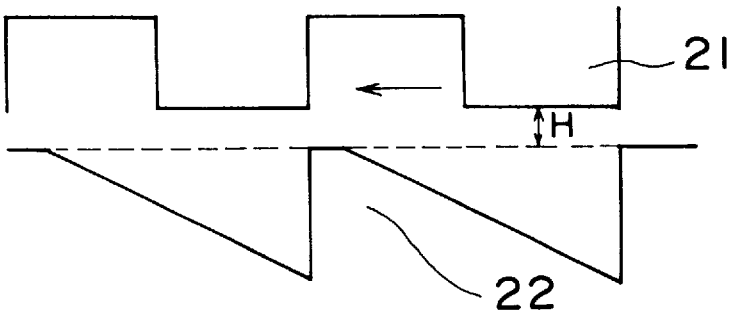
Figure 3C:
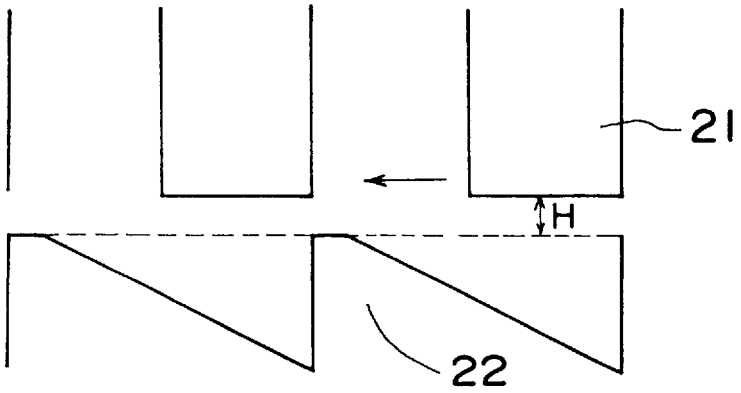

FIG. 3 shows a sectional view of the rotor 21 and liner 22 as cut rectangularly to the direction in which the grooves extend. In FIG. 3 (*a*), grooves of the liner have a sectional configuration of isosceles triangle and are opposed to the grooves of the rotor so that gap H (minimum gap) is in the range of from 0.2 to 10 mm, preferably from 0.3 to 5 mm. The sectional configuration of the liner is not necessarily limited to the one mentioned above, but may be rectangular triangle as shown in FIG. 3(*b*), for example. Also, it is possible to use a rotor having blades arranged thereon, as shown in FIG. 3(*c*), instead of the rotor with grooves formed thereon. Mechanical grinding machines useful for the above described grinding operation are, for example, "Kryptron" (made by Kawasaki Heavy Industries Ltd.), "Turbomill" (made by Turbomill Kogyo), and "Fine Mill" (made by Nippon Pneumatic K.K.).

Above described grinding operation may be carried out on a plural pass treatment basis in a closed circuit. Coarse particles are classified out of toner particles that have undergone the process of crushing by the mechanical grinding machine, and so classified coarse particles are returned to the mechanical grinding machine for circulation.

Classifiers useful for classifying coarse particles out of disintegrated particles include, for example, coarse particle classifiers of the following types: "MS-O", made by Hosokawa Micron; "DS-X Classifier", made by Nippon Pneumatic K.K.; and "Elbow Jet", made by Nittetsu Mining Co.

Finally, fine powder is classified with respect to the pulverized particles thus obtained. For the purpose of classifying operation, it is desirable to employ a classifier capable of applying mechanical impact force. The classifier may be a classification rotor type classifier having a classification rotor. The use of such a rotor provides the following advantages: that particle surface is smoothed or sphered by the impact force applied by the classification rotor; that ultrafine powder of liberated polyethylene and the like is caused to firmly attach to and get buried in the surface of toner particles by the impact force applied by the classification rotor so that liberated ultrafine powder is reduced; that improved efficiency of particle dispersion can be obtained through the dispersion effect of the impact force applied by the classification rotor; and that inclusion of ultrafine powder into toner product can be prevented. Any such effect cannot be obtained by using a conventional air classification device in which particles are sifted according to their weight.

Figure 4:
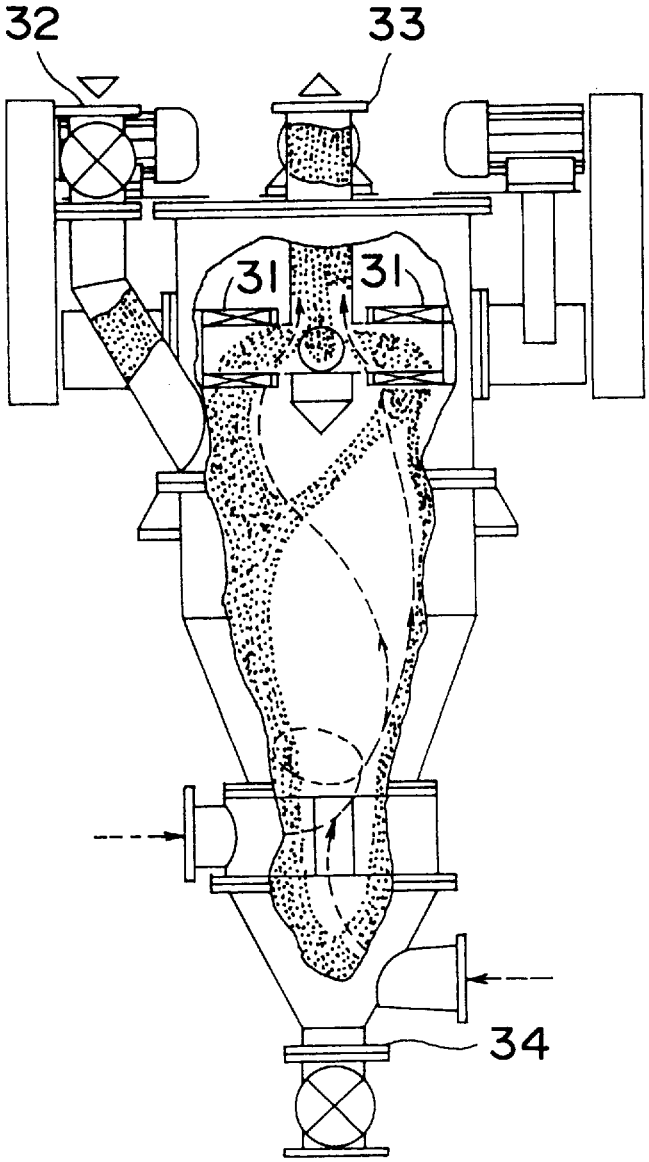
FIG. 4 is a view of a T-prex multi-wheel type classifying machine.

Classification rotor type classifiers of the kind described above are known including, for example, "Turbo Classifier" (made by Nisshin Engineering Co.), "Acucut" classifier, such as "Donaselec Classifier" (made by Donaldson Japan), and "T-prex Ultrafine Powder Classifier" ATP series (made by Hosokawa Micron). Of these classifiers, inter alia, "T-prex Ultrafine Powder Classifier" ATP series is preferred. FIG. 4 shows a schematic skeleton view of "T-prex" multi-wheel type classifier, one of above said ATP series. FIG. 4 is a central vertical section.

Figure 5:
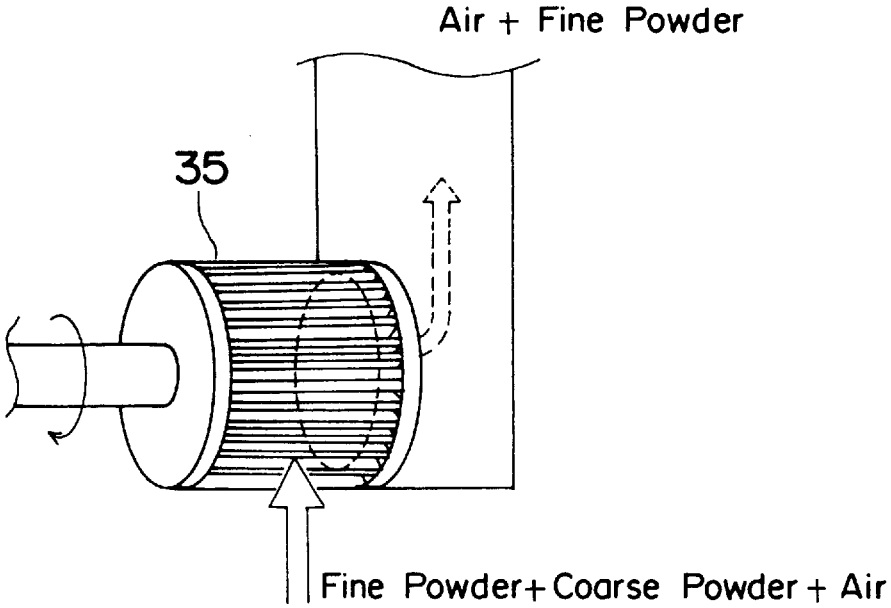
FIG. 5 is a view of a classification rotor.

As can be seen from FIG. 4, material particles (particles from the grinding stage) are introduced through a material inlet port 32 and conveyed through a rotary valve or together with inflow air into a classifying chamber. The inflow air flows upward from below within the classifier as indicated by arrow. The material particles flow upward along with the air flow to enter a classifying section 31 in which the particles are classified, so that fine particles are removed from a common fine-particle discharge port 33 and toner particles are removed from a discharge port 34. The classifying section 31 has a plurality of individually driven classifying rotors 35 mounted horizontally therein. Each of the classifying rotors 35 is a cylindrical rotary body having multiple blades as shown in FIG. 5. Common speed control is effected through one frequency converter.

The toner thus obtained has its wax content dispersed in above described particle size distribution and has a shape factor SF of 130 to 160, preferably 130 to 150, as expressed by the equation given below. With such a shape configuration given, the toner has improved fluidity and charging stability. Further, because of liberated-wax dispersion, the toner has improved anti-filming characteristic. If the shape factor is less than 130, the toner has poor blade cleanability. If the shape factor is more than 160, the toner has low fluidity and low static stability, and is liable to filming.

$$SF = \frac{(\text{maximum length})^2}{\text{area}} \times \frac{\pi}{4} \times 100$$

where, area refers to toner projected area, and maximum length refers to maximum length of projected toner image.

In the toner, the ratio Dv/Dp (Dv is a volume-average particle size and Dp is a number-average particle size) is in the range of from 1.0 to 1.4, preferably from 1.0 to 1.35. If Dv/Dp is larger than 1.4, the toner is liable to filming and/or fogging because the toner has an increased fine powder content, such as liberated wax and the like.

The present invention is illustrated in detail by way of examples as listing some of preferable embodiments.

EXAMPLES

Preparation of Binder-Type Carrier

For purposes of subjecting toner to evaluation tests to be described hereinafter, a binder type carrier is prepared as described below.

| Ingredients | Weight Parts |
|---|---|
| Polyester resin (NE-1110, made by Kao Corp.) | 100 |
| Inorganic magnetic powder (MFP-2, made by TDK K.K.) | 500 |
| Carbon black (MA#8, made by Mitsubishi Chemical Ind. Ltd.) | 2 |

The foregoing materials were thoroughly mixed and crushed in a Henschel mixer, and then the mixture was melt-kneaded by employing an extruder-kneader with temperature settings of 180° in its cylinder portion and 170° in its cylinder head portion. The kneaded product was cooled and coarsely pulverized and then the resulting coarse particles were subjected to fine milling in a jet mill. Then, fine particles from the jet mill were classified by an air classifier. As a result, a magnetic carrier having a volume average particle size of 55 μm was obtained.

| Preparation of coated type carrier<br>Preparation of coating resin | |
|---|---|
| Polyoxypropylene (2,2)-2,2-bis (4-hydroxyphenyl) propane | 350 g |
| Polyoxyethylene (2,2)-2,2-bis (4-hydroxyphenyl) propane | 330 g |
| Isophthalic acid | 400 g |
| Dibutyl tin oxide | 2 g |

The above ingredients were put in a 3-liter four neck glass flask equipped with a thermometer, a stainless stirrer, a condenser, and a nitrogen blowing pipe, and the ingredients were reacted in a mantle heater while being agitated at 200° C. in a nitrogen atmosphere. As a result, a polyester resin of 15 KOHmg/g was obtained.

Preparation of Carrier

The resin thus obtained was diluted with toluene, whereby a polyester resin solution having a solid content of 2% by weight was prepared. Calcined ferrite powder (F-300; mean particle size: 50 μm, bulk density: 2.53 g/cm$^3$; made by Powdertech Co., Ltd.) was used as core material. By using a coating device ("Spira Cota", made by Okada Seiko Co.) the polyester resin solution was applied to the core material so as to provide a resin coat of about 1 weight percent relative to the core material, followed by drying. The resulting carrier was calcined by being allowed to stand at 170° C. in a hot air circulation type oven for 2 hours. After having been cooled, the ferrite powder bulk was disintegrated by a sieve shaking machine equipped with mesh screens of 210 μm and 90 μm in mesh size, into resin coated ferrite powder. The foregoing process of coating, calcination, and disintegration was further repeated three cycles with respect to the ferrite powder. As a result, a resin coated carrier having a volume average particle size of 53 μm was obtained.

Example 1

| | |
|---|---|
| Thermoplastic styrene-acrylic resin<br>styrene-butyl acrylate-butyl methacrylate-methacrylic acid copolymer (monomer weight ratio = 7:1.4:1.4:0.2; acid value 6.5 KOH mg/g) | 100 wt parts |
| Offset preventive additives: | |
| Polypropylene wax<br>(softening point: abt 145° C.)<br>("Viscol 660 P", made by Sanyo Kasei K.K.) | 4 wt parts |
| Polyethylene wax<br>(softening point: abt 140° C.)<br>("HIWAX 800P", made by Mitsui Sekiyu Kagaku K.K.) | 2 wt parts |
| Carbon black<br>("Mogul L", made by Cabot K.K.) | 10 wt parts |
| Nigrosine dye<br>("Nigrosine Base EX", made by Orient Kagaku K.K.) | 5.0 wt parts |
| Quaternary ammonium salt<br>("P-53", made by Orient Kagaku K.K.) | 0.5 wt part |
| Magnetic powder<br>("MFP-2", made by TDK K.K.) | 7 wt parts |

The foregoing materials were mixed in a Henschel mixer (of a 75 liter capacity) operated at 3000 rpm, for 3 minutes. The mixture was subjected to continuous extrusion kneading by a screw extruder-kneader ("TEM 50", made by Toshiba Kikai K.K.) as shown in FIG. 1 under the conditions of: temperature, 120° C.; feed rate, 30 kg/hr; and screw revolution speed, 150 ppm. Then, the kneaded stock was rolled by press rollers 4 with a nip clearance of 1 mm, and was then subjected to forced water cooling on a belt roller 6.

The kneaded stock was then ground into coarse particles by a feather mill (with a mesh size of 2 mm). The coarse particle mass was pulverized by a mechanical grinder ("Kryptron KTM-O", made by Kawasaki Jukogyo K.K.) to a particle size of 11 μm. From particles from the mechanical grinder were separated off the coarse powders by a jet mill equipped with a natural air classifier (model "IDS-2", made by Nippon Pneumatic K.K.), and then was separated off fine powders by a classification rotor-type classifier ("50 ATP Classifier", made by Hosokawa Micron K.K.). As a result, a toner having a volume average particle size of 11 μm was obtained.

The toner thus obtained was added with 0.15% by weight of hydrophobic silica ("R-974", made by Aerosil K.K.).

EXAMPLE 2–6

Comparative Examples 1 and 2

Toner was prepared according to the Example 1.

The types of binder resin, types and quantities of polypropylene, polyethylene, and magnetic powder which were used in these Examples and Comparative Examples are as shown in Tables 1 and 2. Physical properties of toner produced and carrier used in respective Examples and Comparative Examples are also shown in Tables 1 and 2.

Comparative Example 3

A kneaded mass was obtained according to the Example 1. The type of binder resin, and types and quantities of polypropylene wax, polyethylene wax, and magnetic powder which were used are as shown in Table 1. The kneaded mass was coarsely pulverized in a feather mill. The obtained mass was finely milled by a jet mill equipped with a natural air classifier ("IDS-2", made by Nippon Pneumatic K.K.). The resulting fine particle mass was subjected to fine powder classification by a natural air classifier ("DS Classifier", made by Nippon Pneumatic K.K.), whereby a toner was obtained. The toner thus obtained was externally added with hydrophobic silica in the same way as in Example 1. Physical properties of the toner obtained and of the carrier used are as shown in Table 2.

TABLE 1

| | Binder resin | | | Polypropylene wax | | |
|---|---|---|---|---|---|---|
| | Mn | Mw/Mn | Softening point, Tm | Type | Softening point | Add Amount |
| Ex. 1 | 4000 | 68.8 | 121.8 | Viscol 660P | 145° C. | 4 wt parts |
| Ex. 2 | 4000 | 68.8 | 121.8 | Viscol 660P | 145° C. | 4 wt parts |
| Ex. 3 | 4000 | 68.8 | 121.8 | Viscol 660P | 145° C. | 3 wt parts |
| Ex. 4 | 4500 | 83.4 | 127.5 | Viscol 660P | 145° C. | 6 wt parts |
| Ex. 5 | 2800 | 37.0 | 117.3 | Viscol 330P | 152° C. | 3 wt parts |
| Ex. 6 | 4000 | 68.8 | 121.8 | Viscol 550P | 150° C. | 4 wt parts |
| Comp. Ex. 1 | 2800 | 37.0 | 117.3 | Viscol 330P | 152° C. | 3 wt parts |
| Comp. Ex. 2 | 4500 | 83.4 | 127.5 | Viscol 330P | 152° C. | 3 wt parts |
| Comp. Ex. 3 | 4000 | 68.8 | 121.8 | Viscol 660P | 145° C. | 6 wt parts |

| | Polyethylene wax | | | Magnetic powder | | |
|---|---|---|---|---|---|---|
| | Type | Softening point | Add amount | Type | Softening point | BET |
| Ex. 1 | Hi-Wax 800P | 140° C. | 2.0 wt parts | Ferrite MFP-2 | 7 wt parts | 6.9 $m^2/g$ |
| Ex. 2 | Hi-Wax 800P | 140° C. | 0.5 wt part | Ferrite MFP-2 | 2 wt parts | 6.9 $m^2/g$ |
| Ex. 3 | Hi-Wax 800P | 140° C. | 3.0 wt parts | Ferrite MFP-2 | 12 wt parts | 6.9 $m^2/g$ |
| Ex. 4 | Hi-Wax 100P | 121° C. | 2.0 wt parts | Magnetite EPT-1000 | 50 wt parts | 5.0 $m^2/g$ |
| Ex. 5 | Hi-Wax 800P | 140° C. | 4.0 wt parts | Magnetite EPT-1000 | 130 wt parts | 5.0 $m^2/g$ |
| Ex. 6 | Hi-Wax 400P | 136° C. | 0.5 wt part | Magnetite EPT-1000 | 2 wt parts | 5.0 $m^2/g$ |
| Comp. Ex. 1 | Hi-Wax 400P | 136° C. | 4.0 wt parts | Magnetite EPT-1000 | 200 wt parts | 5.0 $m^2/g$ |
| Comp. Ex. 2 | Hi-Wax 400P | 136° C. | 4.0 wt parts | — | — | — |
| Comp. Ex. 3 | — | — | — | Ferrite MFP-2 | 2 wt parts | 6.9 $m^2/g$ |

TABLE 2

| | Toner | | | | Carrier | |
|---|---|---|---|---|---|---|
| | Saturation magnetization | Shape factor | Volume mean particle size | Dv/Dp | Type | Saturation magnetization |
| Ex. 1 | 0.93 emu/g | 137 | 11.0 μm | 1.29 | binder type | 55 emu/g |
| Ex. 2 | 0.19 emu/g | 139 | 11.0 μm | 1.28 | binder type | 55 emu/g |
| Ex. 3 | 1.65 emu/g | 141 | 10.9 μm | 1.28 | binder type | 55 emu/g |
| Ex. 4 | 8.80 emu/g | 138 | 11.1 μm | 1.28 | coat type | 63 emu/g |
| Ex. 5 | 8.41 emu/g | 144 | 10.8 μm | 1.30 | coat type | 63 emu/g |
| Ex. 6 | 0.24 emu/g | 142 | 11.0 μm | 1.31 | coat type | 63 emu/g |
| Comp. Ex. 1 | 36.2 emu/g | 148 | 10.8 μm | 1.32 | binder type | 55 emu/g |
| Comp. Ex. 2 | 0 emu/g | 132 | 11.2 μm | 1.27 | binder type | 55 emu/g |

TABLE 2-continued

| | | | | | | | |
|---|---|---|---|---|---|---|---|
| Comp. Ex. 3 | 0.19 emu/g | 162 | 11.5 μm | 1.44 | binder type | 55 emu/g | |

| | Evaluation | | | | | Image density | Anti- |
|---|---|---|---|---|---|---|---|
| | Smear | Filming | Charge | Dusting | Spill | (ID) | offset |
| Ex. 1 | ○ | ○ | 19.1 μC/g | ○ | ○ | ◎ | ○ |
| Ex. 2 | ○ | ○ | 22.7 μC/g | ○ | ○ | ◎ | ○ |
| Ex. 3 | ○ | ○ | 16.9 μC/g | ○ | ○ | ◎ | Δ |
| Ex. 4 | ○ | ○ | 14.3 μC/g | ○ | ○ | ○ | ○ |
| Ex. 5 | ○ | ○ | 10.4 μC/g | ○ | ○ | Δ | ○ |
| Ex. 6 | ○ | Δ | 24.8 μC/g | ○ | ○ | ◎ | ○ |
| Comp. Ex. 1 | ○ | ○ | 7.2 μC/g | ○ | ○ | x | Δ |
| Comp. Ex. 2 | ○ | x | 24.6 μC/g | x | x | ◎ | ○ |
| Comp. Ex. 3 | x | x | 17.7 μC/g | Δ | Δ | ◎ | ○ |

Analysis and Evaluation Method (1) Mean Particle Size

Measurement of volume mean particle size of carrier was carried out by using a 280 μm aperture tube in combination with a Coaltar Multisizer (made by Coaltar Company). Measurement of volume mean particle size and number mean particle size of toner is carried out by using a 100 μm aperture tube in combination with aforesaid multisizer.

(2) Saturation Magnetization

Measurement of saturation magnetization was made by using a DC magnetization characteristic automatic recording device ("TYPE-3257", made by Yokokawa Hokushin Denki Co.) and under the conditions of magnetic field 1 KOe.

(3) Toner Shape Factor

Shape factor (SF) herein is defined by the relation given below and expresses the difference between major axis and minor axis (distortion) in toner particle size. If toner particles are completely spherical, SF=100. Each shape factor value given is an average of measurements made by using an image analyzer ("Loozex 5000", made by Nihon Regulator Co.).

$$SF = \frac{(\text{maximum length})^2}{\text{area}} \times \frac{\pi}{4} \times 100$$

where, area refers to toner projected area, and maximum length refers to maximum length of projected toner image.

(4) Smear Characteristic

A toner image was fixed on a copy sheet by using a copying machine (modified "EP4050", made by Minolta Co., Ltd.). Then, a separate unused copy sheet was rubbed against the sheet on which a toner image was previously formed. The extent to which the unused copy sheet was stained due to the rubbing was observed. Ranking was made according to the following criteria.

○: No or little stain noticeable.

Δ: Some stain observed, but no problem for practical purposes.

x: Stains observed all over the sheet.

(5) Filming Characteristic

After continuous copying of 50,000 sheets was made using a copying machine (modified "EP4050", made by Minolta Co., Ltd.), half tone images were collected and, at the same time, the condition of the photosensitive element was observed. With respect to the test results, ranking was made on the following criteria.

○: No image stain, no deposition of toner component on the photosensitive element.

Δ: Part of photosensitive element found slightly cloudy, but no image disturbance observed.

x: Photosensitive element found cloudy all over, and image disturbance observed.

(6) Quantity of Charge

Figure 6:
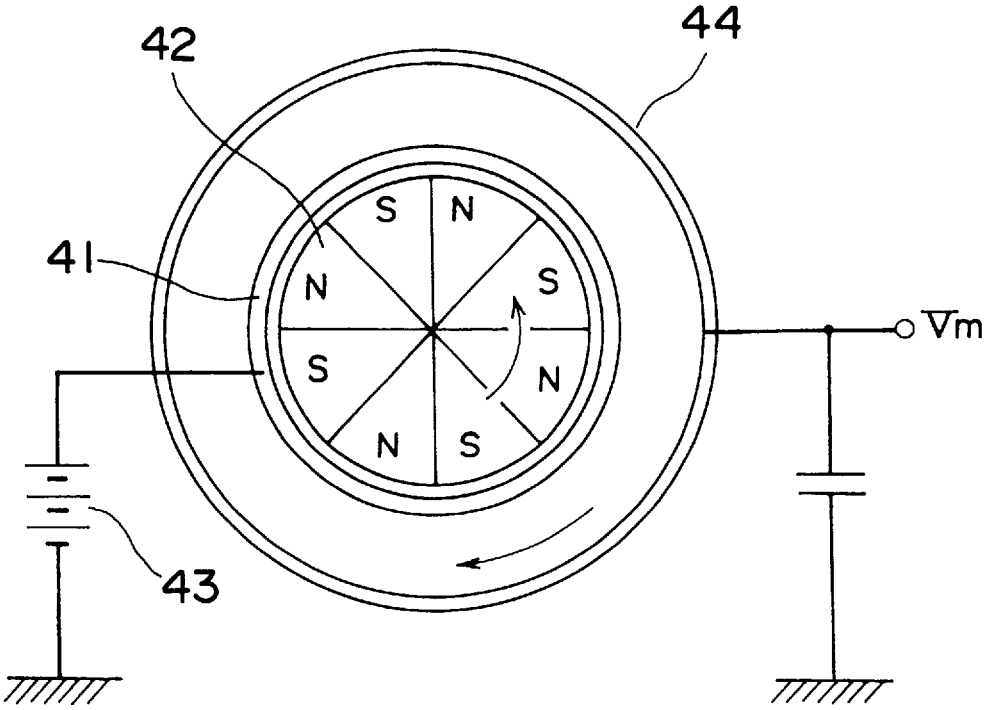
FIG. 6 is a view of a charging device for test.

In order to find the quantity of charge (μC/g), toners were loaded with respective carriers so that the weight ratio of toner/carrier=5/95 (Tc=5 wt %) could be attained. These mixture sets were each put in a 50 cc plastic bottle which, in turn, was rotated as mounted on a rotary base at 120 rpm for 10 minutes. Thus, developers using respective toners were prepared. For the purpose of measuring the quantity of charge (μC/g), 1 g of each developer as weighed by a precision balance was placed on an electroconductive sleeve 41 of a charging device shown in FIG. 6 in such a manner that the developer could be uniformly spread over the entire surface of the charging device. A magnet roll 42 mounted within the conductive sleeve 41 was set for rotation at 100 rpm.

A 3 kv bias voltage was applied by a bias source 43 in a direction opposite to the charge potential of the toner, and the electroconductive sleeve 41 was rotated for 30 seconds. When the rotation of the conductive sleeve 41 was stopped, potential Vm at a cylindrical electrode 44 was read, and the quantity of toner deposited on the cylindrical electrode 44 was weighed by a precision balance. In this way, average quantity of charge (μC/g) on each toner was measured.

(7) Dusting and Spill

After 50K sheets copying was made using a copying machine (modified "EP4050", made by Minolta Co., Ltd.), toner dusting within the copying machine and toner spill from the developing unit were observed. Ranking was made as follows.

○: No or little problem for practical purposes.

Δ: No problem found up to 10K sheets, but maintenance was required after 50K sheets copying.

x: Toner dusting occurred around the developing unit before the end of 10K sheets copying. In some cases, toner drops found on reproduced image.

(8) Image Density (ID)

After a toner image was fixed on a copy sheet by using a copying machine (modified "EP4050", made by Minolta Co., Ltd.) incorporating some adaptation, image density in solid portions was measured by using a Macbeth reflection densitometer ("RD920", made by Macbeth Co.).

◎: ID of 1.4 or more

○: ID of 1.2 or more but less than 1.4

Δ: ID of 1.0 or more but less than 1.2 x: ID of less than 1.0

(9) Anti-Offset Characteristic

As fixing roller temperature was raised to the proximity of 250° C., temperatures at which offsetting occurred were observed. Rating was made according to the level of such temperature, as indicated below.

○: No offset occurrence at 250° C.

Δ: Offset does not occur at temperatures lower than 250° C.

x: Offset occurs at a temperature lower than 230°.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A toner used for two-component developing agent containing at least a magnetic carrier and a toner, which toner comprises at least a binder resin, a colorant, a wax containing polyethylene and polypropylene, and magnetic powder, in which total amount of the polyethylene and polypropylene is in a range of 2 to 10 parts by weight relative to 100 parts by weight of the binder resin, weight ratio of the polypropylene to the polyethylene is 10:1 to 1:10, said magnetic powder has a BET specific surface area of from 2 to 15 $m^2/g$, and an amount of from 1 to 150 parts by weight relative to 100 parts by weight of the binder resin.

2. A toner of claim 1, in which the amount of magnetic powder is 2 to 100 parts by weight based on 100 parts by weight of the binder resin.

3. A toner of claim 1, in which the magnetic powder is selected from ferrite and magnetite.

4. A toner of claim 1, in which the polypropylene has a softening point of 140° C. to 160° C. and the polyethylene has a softening point of 100° C. to 150° C., and the former has a higher softening point than the latter has.

5. A toner of claim 4, in which the polypropylene has a softening point of 145° C. to 155° C. and polyethylene has a softening point of 130° C. to 145° C., and the softening point of the former is higher than the latter by 3° to 30° C.

6. A toner of claim 1, in which the weight ratio of polypropylene to polyethylene is 10:1 to 1:2.

7. A toner of claim 1, in which the binder resin is a styrene copolymer having a number average molecular weight of 2000 to 10000 and a ratio of weight average molecular weight to number average molecular weight of 20 to 90.

8. A toner of claim 7, in which the styrene copolymer is a copolymer of at least one of monomer selected from the group consisting of styrene, α-methyl styrene, p-methyl styrene, p-tert-butyl styrene, p-chlorostyrene and a derivative thereof and another monomer selected from the group consisting of alkyl methacrylate, alkyl acrylate, unsaturated carboxylic acid, and vinyl monomer and derivative thereof.

9. A toner of claim 8, in which the styrene copolymer contains at least one of unsaturated carboxylic acids, and has an acid value of 3 to 10.0 KOH mg/g.

10. A toner of claim 1, in which the toner has a shape factor SF of 130 to 160, and a ratio of volume average particle size to number average particle size (Dv/Dp) of 1.0 to 1.4.

11. A toner of claim 1, in which the toner additionally contains on its surface a fluidizing agent selected from a fine particle silica or a fine particle titanium oxide.

12. A toner of claim 1, in which the toner additionally contains charge control agent selected from nigrosine dye, triphenylmethanes and quaternary ammonium compounds.

13. A toner of claim 1, in which the carrier is a binder type carrier in which magnetic powders are dispersed in a binder resin or a coated carrier in which magnetic core carriers are coated with resin.

14. A toner of claim 13, in which the binder resin for the binder type carrier or the resin for the coated carrier is a polyester resin.

15. A toner of claim 1, in which the carrier has a saturation magnetization of 35 to 90 emu/g and a volume average particle size of 15 to 100 μm.

16. A toner used for two-component developing agent containing at least a magnetic carrier and a toner, which toner comprises at least a binder resin, a colorant, a wax containing polyethylene and polypropylene, and magnetic powder, in which total amount of the polyethylene and polypropylene is in a range of 2 to 10 parts by weight relative to 100 parts by weight of the binder resin, a weight ratio of the polypropylene to the polyethylene is 10:1 to 1:10, and a saturation magnetization of the toner is 0.05 to 30 emu/g.

17. A toner of claim 16 which has the saturation magnetization of 0.1 to 10 emu/g.

18. A toner of claim 16, in which the polypropylene has a softening point of 140° C. to 160° C. and the polyethylene has a softening point of 100° C. to 150° C., and the former has a higher softening point than the latter has.

19. A toner of claim 16, in which the binder resin is a styrene copolymer having a number average molecular weight of 2000 to 10000 and a ratio of weight average molecular weight to number average molecular weight of 20 to 90.

20. A toner of claim 16, in which the toner has a shape factor SF of 130 to 160, and a ratio of volume average particle size to number average particle size (Dv/Dp) of 1.0 to 1.4.

* * * * *